US006910945B2

(12) United States Patent
Suzuki et al.

(10) Patent No.: US 6,910,945 B2
(45) Date of Patent: Jun. 28, 2005

(54) HONING METHOD AND HONING APPARATUS

(75) Inventors: Kiyohisa Suzuki, Ebina (JP); Takashi Iiya, Tokyo (JP)

(73) Assignee: Nissan Motor Co., Ltd., Yokohama (JP)

( * ) Notice: Subject to any disclaimer, the term of this patent is extended or adjusted under 35 U.S.C. 154(b) by 0 days.

(21) Appl. No.: 10/649,972

(22) Filed: Aug. 28, 2003

(65) Prior Publication Data

US 2004/0048558 A1 Mar. 11, 2004

(30) Foreign Application Priority Data

Aug. 30, 2002 (JP) ..... 2002-255887

(51) Int. Cl.[7] ..... B24B 49/00; B24B 1/00

(52) U.S. Cl. ..... 451/7; 451/51; 451/53; 451/61; 451/120; 451/121; 451/123; 451/150

(58) Field of Search ..... 451/51, 61, 120, 451/121, 123, 124, 132, 133, 134, 140, 136, 150, 155, 7, 53

(56) References Cited

U.S. PATENT DOCUMENTS 2,167,758 A * 8/1939 Johnson et al. ..... 51/156
2,323,780 A * 7/1943 Kline ..... 451/213
2,697,952 A * 12/1954 Otto ..... 408/34
2,763,106 A * 9/1956 Evashevski ..... 451/49
2,896,308 A * 7/1959 Swords ..... 408/4
2,917,874 A * 12/1959 Lierse ..... 451/213
3,087,281 A * 4/1963 Greening et al. ..... 451/27
3,339,312 A * 9/1967 Hannon ..... 451/163
3,496,678 A * 2/1970 Engle ..... 451/124
4,980,996 A 1/1991 Klink et al.
5,371,978 A 12/1994 Higashikawa

FOREIGN PATENT DOCUMENTS

DE 41 24 769 A1 1/1993
JP 5-57597 A 3/1993
JP 5-57598 A 3/1993

* cited by examiner

*Primary Examiner*—M. Rachuba
(74) *Attorney, Agent, or Firm*—Foley & Lardner LLP

(57) ABSTRACT

In a coarse honing step in a section (101), a honing head (15) provided with coarse honing hones (17) is inserted into a cylinder bore (13) of a cylinder block (11), the honing head 15 is rotated while axially moving it, and the inner peripheral surface of the cylinder bore (13) is thereby ground. In the next idling step in a section (102), the cylinder block (11) is left as it is for (60) seconds to generate a springback (S). In a subsequent finishing honing step in a section (103), a honing head (21) provided with finishing honing hones (19) is inserted into the cylinder bore (13), the honing head (21) is rotated in a reverse direction to a rotational direction in the coarse honing step while axially moving it, and the inner peripheral surface of the cylinder bore (13) is thereby ground. Further, a coolant is supplied to the sections of the coarse honing step, the idling step, and the finishing honing step from coolant nozzles (23), (25), and (27), respectively, using a common coolant supply source (29).

9 Claims, 5 Drawing Sheets

HONING METHOD AND HONING APPARATUS

BACKGROUND OF THE INVENTION

1. Field of the Invention

The present invention relates to a honing method and a honing apparatus for grinding the inner surface of a workpiece carried on a machining line by rotating a honing head having hones relative to the workpiece while axially moving the honing head.

2. Description of the Related Art

A workpiece having a cylindrical inner surface, e.g., the cylinder bore of a cylinder block is an important region that determines engine performance. For this reason, the cylinder bore is required to have high shape accuracy and good surface profile. As the shape accuracy, it is required to make the roundness and cylindricity of the cylinder bore as high as possible in order to reduce piston sliding resistance. As for the surface profile, it is desirable to ensure enough roughness to hold oil and expose graphite, serving as a fixed lubricant, to the surface of the bore as much as possible in order to decrease the seizure (scuff) of the piston.

To satisfy these conditions, a honing head 5 having hones 3 is inserted into th inner peripheral surface of the cylinder bore 1, rotated and axially moved to conduct grinding, thereby executing the honing of the cylinder bore 1 as shown in FIG. 8. The honing head 5 has a plurality of hones 3 in a circumferential direction and the honing head 5 hones the inner peripheral surface of the cylinder bore 1 while pressing the hones 3 radially outward, i.e., toward the bore inner peripheral surface of the cylinder bore 1 with a predetermined expansion pressure.

In the above-mentioned honing, it is necessary to secure a certain amount of machining allowances so as to remove roughness generated by boring, a preprocessing to the honing. Normally, therefore, with a view of minimizing honing time, coarse honing having high grinding efficiency is conducted to most of the machining allowance and, after the coarse honing, finishing honing having low grinding efficiency is conducted to improve the shape accuracy and the surface profile.

During the coarse honing, in order to secure an amount of machining allowances as described above, the cylinder bore 1 is largely deformed by the expansion pressure which is a pressure with which the hones 3 are pressed against the cylinder bore 1. FIG. 9A shows the deformation state of the cylinder bore 1 during the coarse honing. According to FIG. 9A, the cylinder bore 1 is deformed so as to largely widen the upper opening side of the cylinder bore 1 radially outward and to decrease the inside diameter of the lower portion of the cylinder bore 1.

If the expansion pressure of the hones 3 is released and the workpiece is left as it is in this deformation state, a function of returning the inner peripheral surface of the pressed cylinder bore 1 to the central side, i.e., springback indicated by arrows S occurs. As a result, the shape of the cylinder bore 1 becomes, for example, that shown in FIG. 9B.

If the subsequent finishing honing is carried out continuously to the coarse honing while the cylinder bore 1 is being deformed as shown in FIG. 9A, it becomes disadvantageously difficult to highly accurately secure the shape of the cylinder bore 1 due to the influence of the springback.

In addition, to secure the shape accuracy, such measures as to decrease the expansion speed of the hones during the coarse honing to thereby decrease the springback of the workpiece or to lengthen finishing honing time may be considered. However, these measures disadvantageously lengthen machining time and push up manufacturing cost.

SUMMARY OF THE INVENTION

It is, therefore, an object of the present invention to allow the shape of a workpiece to be secured highly accurately in finishing honing without bringing about the extension of machining time.

To achieve the object, a first aspect of the present invention provides a honing method for grinding an inner surface of a cylinder of a workpiece that is carried on a machining line by rotating a honing head having hones while axially moving the honing head, characterized in that in a coarse honing step, coarse honing is conducted to the inner surface of the cylinder, in an idling step, the workpiece is left as it is for a predetermined time without inserting the honing head into the cylinder, and in a subsequent finishing honing step, the honing head is rotated in a reverse direction to a rotational direction in the coarse honing step, thereby conducting honing to inner surface of the cylinder of the workpiece.

A second aspect of the present invention provides the honing method according to the first aspect, wherein a coolant is supplied to the workpiece in the idling step.

A third aspect of the present invention provides the honing method according to the second aspect, wherein the coolant is set equal in temperature to coolants used in the coarse honing step and the finishing honing step.

A fourth aspect of the present invention provides the honing method according to any of the first to the third aspect, wherein a time for which the workpiece is left as it is in the idling step is at least 30 seconds. If the workpiece leaving time is less than 30 seconds, a return deformation quantity by the springback function after the coarse honing step is insufficient as shown in FIG. 3, with the result that the subsequent finishing honing step is influenced by the springback.

A fifth aspect of the present invention provides a honing apparatus for grinding an inner surface of a cylinder of a workpiece that is carried on a machining line by rotating a honing head having hones while axially moving the honing head, the honing apparatus comprising: a section of a coarse honing step and a section of a finishing honing step provided on the machining line; and a section of an idling step for leaving the workpiece, which has been subjected to the coarse honing step, as it is for a predetermined time without inserting the honing head into the cylinder, the idling step section provided between the coarse honing step section and the finishing honing step section, characterized in that a rotational direction of the honing head in the finishing honing step is reverse to a rotational direction of the honing head in the coarse honing step.

According to the first or the fifth aspect of the invention, the idling step for leaving the workpiece as it is for a predetermined time is provided between the coarse honing step and the finishing honing step on the same line. Therefore, the workpiece is deformed by springback during this idling step, it is possible to eliminate the influence of the springback in the following finishing honing step, and it is possible to highly accurately secure the shape of the workpiece. In addition, since this idling step is set on the same line as that of the coarse honing step and the finishing honing step and provided therebetween, it is unnecessary to separately provide a dedicated space for leaving the workpiece as it is, excessive time is not generated and the extension of machining time is thereby avoided.

Furthermore, in the finishing honing, the honing head is rotated in a reverse direction to the rotational direction in the coarse honing. Due to this, plastic flow on the honing target surface of the workpiece generated in the finishing honing is generated in a reverse direction to the direction of plastic flow generated in the coarse honing and the plastic flow in the finishing honing functions to cancel the plastic flow in the coarse honing. As a result, it is possible to decrease the plastic flow in the finishing honing, suppress the occurrence of microscopic burrs, and thereby obtain a highly accurately honed surface.

According to the second aspect of the invention, by supplying the coolant to the workpiece in the idling step, the temperature change of the workpiece becomes uniform as a whole and a springback quantity becomes uniform on the honing target surface as a whole. Therefore, it is possible to prevent machining allowance from becoming unnecessarily large in the finishing honing and shorten finishing honing time.

According to the third aspect of the invention, the coolant supplied in the idling step is set equal in temperature to the coolant used in the coarse honing step and the finishing honing step. By setting so, it is possible to share the coolant supply source among these steps, it is unnecessary to separately provide a dedicated coolant supply source to the idling step, and it is thus possible to simplify the entire apparatus.

According to the fourth aspect of the invention, by setting the time for leaving the workpiece as it is in the idling step to at least 30 seconds, a return deformation quantity by the springback function after the coarse honing is sufficiently obtained and it is possible to eliminate the influence of the springback in the subsequent finishing honing.

BRIEF DESCRIPTION OF THE ACCOMPANYING DRAWINGS

FIGS. 9A and 9B are cross-sectional views of a cylinder bore, wherein FIG. 9A is a cross-sectional view of the cylinder bore right after coarse honing and FIG. 9B is a cross-sectional view of the cylinder bore which is left as it is for a predetermined time after the coarse honing.

DETAILED DESCRIPTION OF THE PREFERRED EMBODIMENTS

The embodiment of the present invention will be described hereinafter with reference to the drawings.

Figure 1:
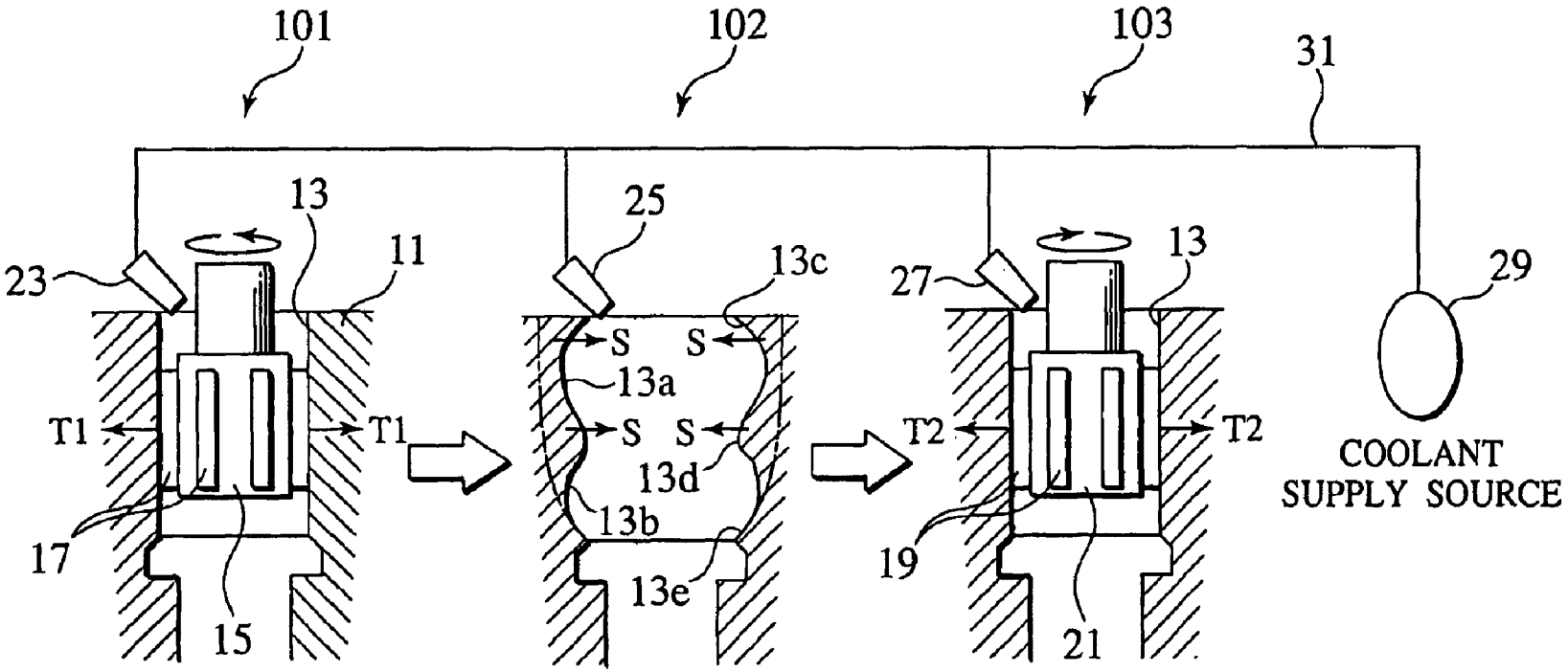
FIG. 1 is a honing step view showing a honing method in one embodiment according to the present invention.

FIG. 1 shows a honing method in one embodiment according to the present invention. In FIG. 1, reference symbol 101 denotes a coarse honing step section for the honing method, and 103 denotes a finishing honing step section therefore. Further, between the coarse honing step section 101 and the finishing honing step section 103, an idling step section 102 for leaving a workpiece as it is for a predetermined time ("left-alone time" or "leaving time") is provided. These step sections are set on the same machining line (working line). An engine cylinder block 11 having a cylindrical inner surface is carried on this line as a workpiece in the order of the coarse honing step section 101, the idling step section 102 and the finishing honing step section 103.

As shown in the coarse honing step of FIG. 1, a honing head 15 is inserted into the cylinder bore 13 of the cylinder block 11. A plurality of rectangular parallelepiped coarse honing hones 17 long in a longitudinal direction in FIG. 1 are provided on the outer peripheral portion of the honing head equidistantly in a circumferential direction.

These coarse honing hones 17 can be pressed against the inner peripheral surface of the cylinder bore 13 with a predetermined expansion pressure $T_1$ by an expansion pressure mechanism which is not shown. The honing head 15 provided with such coarse honing hones 17 conducts coarse honing to the inner peripheral surface of the cylinder bore 13 by rotating axially, i.e., longitudinally in FIG. 1, while moving.

In the finishing honing section 103 shown in FIG. 1, the cylinder bore 13 of the cylinder block 11 is finished using a honing head 21 provided with finishing honing hones 19. Similarly to the coarse honing hones 17, a plurality of rectangular parallelepiped finishing honing hones 19 long in the longitudinal direction in FIG. 1 are provided equidistantly in the circumferential direction, and the finishing honing hones 19 can be pressed against the inner peripheral surface of the cylinder bore 13 with a predetermined expansion pressure $T_2$ by an expansion pressure mechanism which is not shown.

The honing head 21 provided with these finishing honing hones 19 rotates while axially moving similarly to the honing head 15 for the coarse honing. However, the rotational direction of the honing head 21 is reverse to that during the coarse honing.

For the steps of the sections 101, 102 and 103, coolant nozzles 23, 25 and 27 for supplying a coolant as a cooling liquid into the cylinder bore 13 are disposed, respectively. The coolant is supplied to the respective coolant nozzles 23, 25 and 27 from a common coolant supply source 29 through a piping 31.

The cylinder block 11 having the cylinder bore 13 subjected to the coarse honing in the step of coarse honing step section 101 is carried to the next idling step section 102, where the cylinder block 11 is left as it is for a 60 seconds of predetermined time. While the cylinder block 11 is left as it is, the other cylinder blocks are subjected to coarse honing and finishing honing in the coarse honing step section 101 and the finishing honing step section 103 provided before and after the idling step section 102, respectively. The time for which the cylinder block 11 is left in the idling step section 102 may be at least 30 seconds.

Figure 9A:
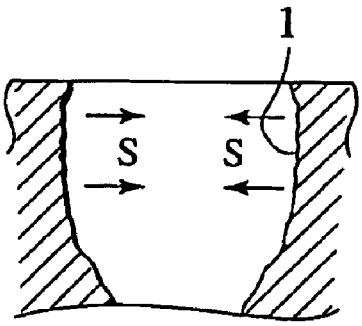
Figure 9B:
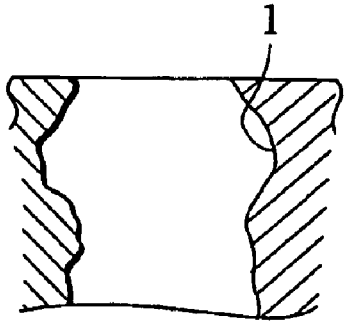

Right after the coarse honing in the coarse honing step section 101, the cylinder bore 13 is deformed similarly to FIG. 9A by the expansion pressure $T_1$ applied from the coarse honing hones 17 as indicated by a two-dot chain line in the idling step section 102 in FIG. 1. In this deformation state, if the cylinder block 11 is left as it is without inserting the honing head into the cylinder bore 13, the cylinder bore 13 is contractedly deformed by the function of springback S as indicated by a solid line in the idling step section 102 in FIG. 1.

Figure 2:
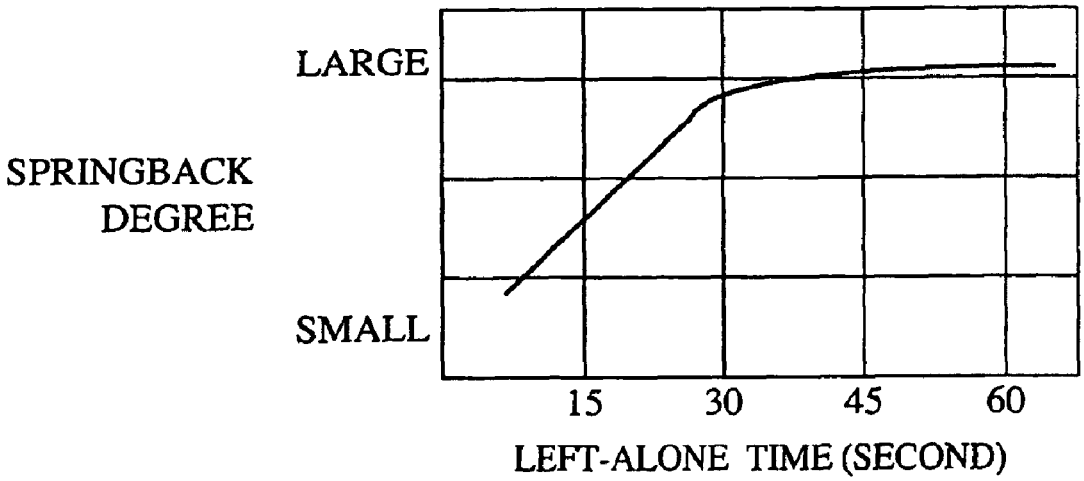
FIG. 2 shows the correlation between a workpiece leaving time and a springback quantity after coarse honing.

As shown in FIG. 2, if the contractedly deformed cylinder bore 13 is left as it is for 60 seconds, a springback quantity (springback degree) becomes nearly a maximum. Differently from the cylinder bore 13 having an upper portion of a larger diameter with the diameter gradually becoming smaller toward the lower portion right after the coarse honing as indicated by the two-dot chain line in the idling step section 102 in FIG. 1, the cylinder bore 13 in the state of the maximum springback quantity has concave portions 13*a*, 13*b* and the like almost equal to one another in inside diameter in the axial direction and convex portions 13*c*, 13*d*, 13*e* and the like adjacent the respective concave portions and almost equal to one another in inside diameter.

As stated above, the cylinder block 11 left as it is for 60 seconds after the coarse honing is carried to the next finishing honing step section 103, where the cylinder block 11 is subjected to finishing honing by rotating the honing head 21 provided with the finishing honing hones 19 in a direction reverse to the direction in the coarse honing section 101.

In the coarse honing step section 101, the expansion pressure $T_1$ is made several times as high as the expansion pressure $T_2$ during the finishing honing so as to hone much machining allowance (working allowance) in short time. Due to this, the springback of the cylinder block 11 right after the coarse honing is quite large in quantity and it takes about 60 seconds until the return deformation caused by this springback becomes nearly a maximum.

The setting of this idling step section 102 has the following two advantages.

First, since the influence of the springback after the coarse honing is quite small during the finishing honing, it is possible to determine honing accuracy almost only by the capability of the finishing honing. The second advantage is as follows.

Figure 3:
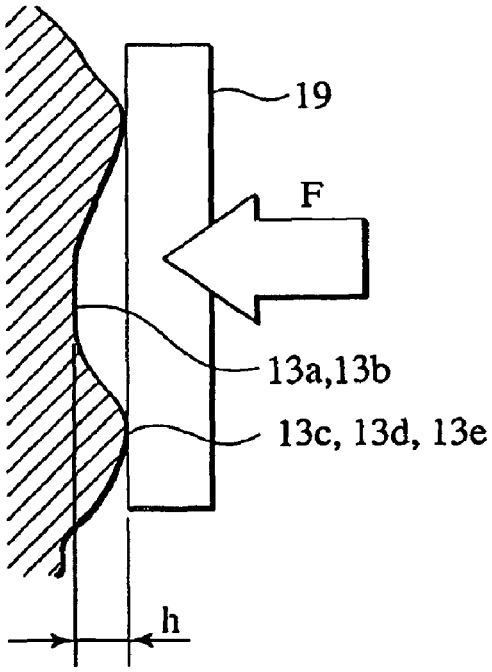
FIG. 3 is an explanatory view showing a state in which a finishing honing hone abuts against a honing target surface.

During the coarse honing, the cylinder bore 13 is forcedly widened by the coarse honing hones 17 as indicated by the two-dot chain line in the idling step section 102 in FIG. 1. When the cylinder bore 13 is left as it is for 60 seconds after the completion of the coarse honing, the concave portions 13*a*, 13*b* and the like and the convex portions 13*c*, 13*d*, 13*e* and the like are generated as indicated by the solid line in the idling step section 102 in FIG. 1. These concave and convex portions make the abutment of each finishing honing hone 19 against the honing target surface local as shown in FIG. 3.

At this time, each of the finishing honing hones 19 is pressed against the honing target surface with a fixed force F, so that the surface pressure of the regions of the finishing honing hone 19 that are locally abutted against the honing target surface increases. Honing is featured in that as the surface pressure increases, the quantity of the abrasive grains of the hone cut into the honing target surface increases and grinding efficiency increases. Therefore, honing time for honing the honing target surface having irregularities is shorter than honing time for honing the honing target surface having no irregularities (the full abutment of the hone against the honing target surface).

The protrusion quantity h (see FIG. 3) of each of the convex portions 13*c*, 13*d*, 13*e* and the like relative to each of the concave portions 13*a* and 13*b* on the honing target surface is about 30 to 50% of the machining allowance for the finishing honing. In this case, the machining time (working time) is advantageously about 10% shorter than the conventional machining time during the finishing honing.

Figure 4:
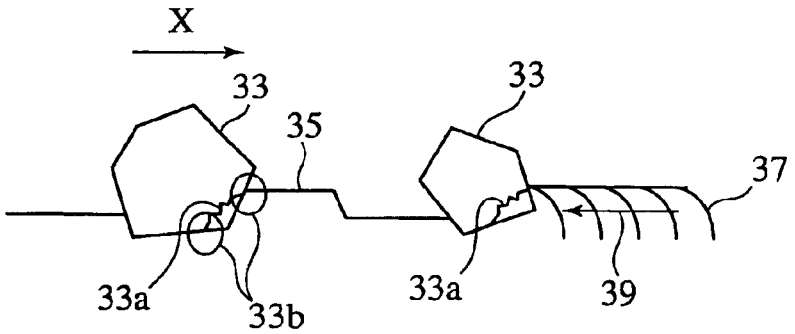
FIG. 4 is an explanatory view showing the autogeneous function of the hone.

Furthermore, as shown in FIG. 4, as the quantity of the abrasive grains 33 that are cut into the honing target surface 35 increases, load on the abrasive grains 33 of the finishing honing hones 19 increases, fractures 33*a* tend to occur (a so-called autogeneous function as hones becomes active), new cutting edges 33*b* are generated to improve cutting. It is noted that a direction indicated by an arrow X is the moving direction of the finishing honing hone 19, reference symbol 37 denotes plastic flow generated in the coarse honing step section 101 and 39 denotes resistance force (load) caused by this plastic flow 37.

As a result, a chain of advantages of the reduction of grinding force→the reduction of bore deformation and plastic flow→the improvement of honing accuracy are attained.

When the finishing honing is conducted subsequently, the local abutment of the finishing honing hones 19 against the honing target surface 35 gradually decreases and changes to full abutment. However, since the abrasive grains 33 are kept cutting well, the above-stated advantages are maintained until the completion of the honing (the machining allowance since the hones fully abut against the honing target surfaces until the end of honing is about Φ10 to 15 μm).

Figure 6:
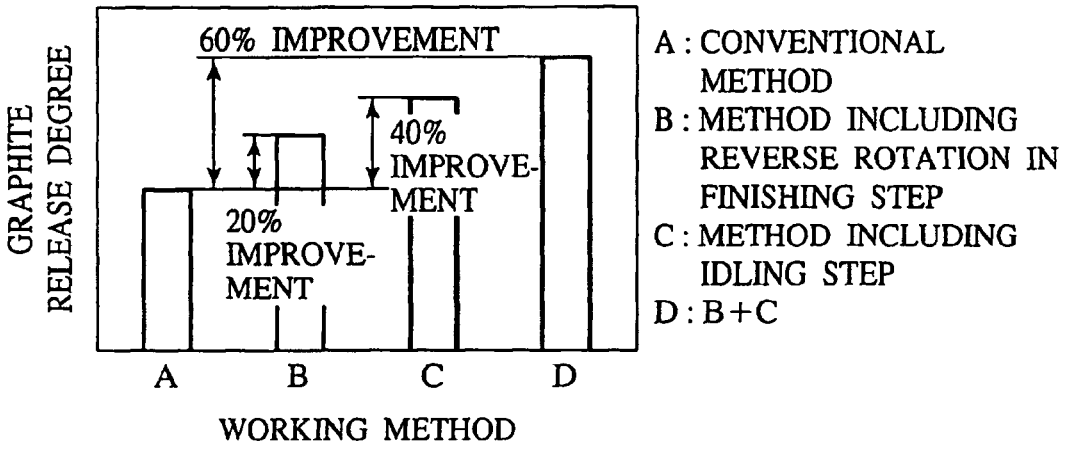
FIG. 6 is an explanatory view showing the comparison of the release degree of graphite exposed to the honing target surface according to the present invention to that of the conventional art.

Thanks to these functions, the shape accuracy (roundness, cylindricity) of the cylinder bore 13 using a honing method C in which the idling step section 102 is provided improves about 30% from that using a conventional honing method A. In addition, as shown in FIG. 6, the exposure degree of graphite to the inner peripheral surface of the cylinder bore 13 using the honing method C in which the idling step section 102 is provided improves about 40% from that using the conventional honing method A.

The exposure degree of graphite increases because of the reduction of plastic flow, as will be described later.

Next, the advantage of setting the rotational direction of the honing head 21 in the finishing honing step section 103 to be reverse to the rotational direction of the honing head 15 in the coarse honing step section 101 will be described.

Figure 7:
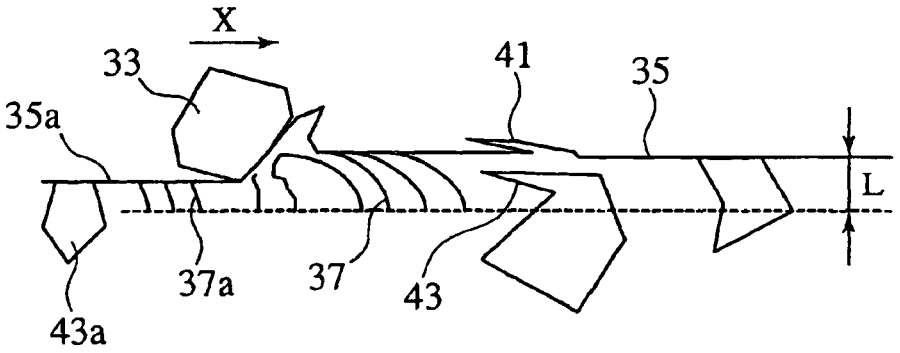
FIG. 7 is an explanatory view showing the principle of the improvement of the surface profile of the honing target surface.
Figure 8:
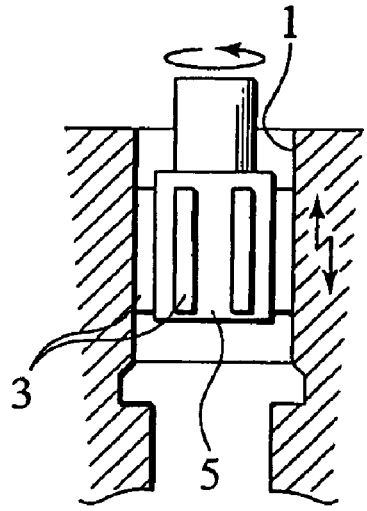
FIG. 8 is a cross-sectional view showing honing.

As already stated above, in the coarse honing step section 101, the expansion pressure $T_1$ of the coarse honing hones 17 is high and the abrasive grains of the coarse honing hones 17 larger in grain size than the abrasive grains of the finishing honing hones 19 are used in order to improve grinding efficiency. Due to this, as shown in FIG. 7, as a result of the coarse honing, a honed surface 35 having plastic flow 37 having a relative large depth L and microscopic burrs 41 is generated. Further, much graphite 43 unexposed to the honed surface 35 is generated by the influence of the surface 35.

To set the rotational direction of the honing head 21 in the finishing honing step section 103 reverse to that in the coarse honing step section 101 means that the abrasive grains 33 move in a direction reverse to the direction of the plastic flow 37 in the coarse honing step. Such movement of the abrasive grins 33 causes a well-known material peel-off effect. Further, plastic flow 37*a* caused by the abrasive grains 33 of the finishing honing hones 19 is generated in the reverse direction to that of the plastic flow 37 in the coarse honing step. Therefore, the plastic flow 37*a* acts to cancel the plastic flow 37 generated in the coarse honing.

Figure 5:
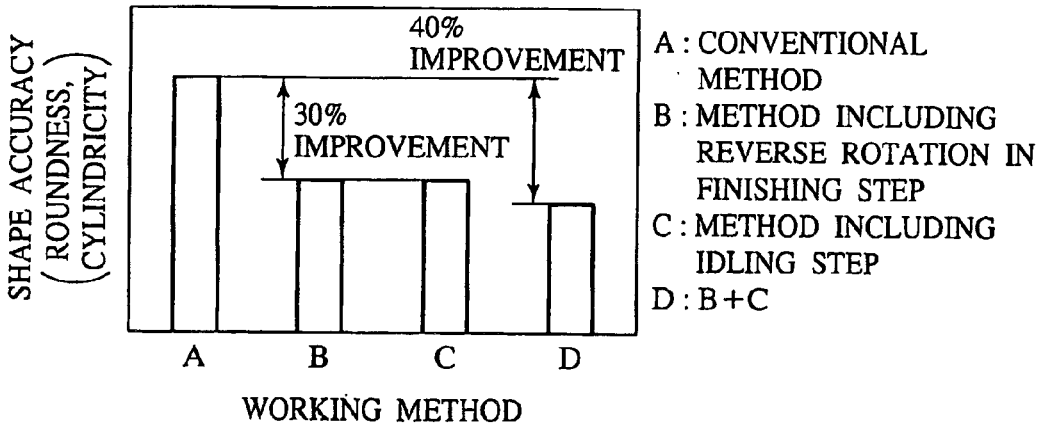
FIG. 5 is an explanatory view showing the comparison of the shape accuracy of the honing target surface according to the present invention to that of the conventional art.

Through these functions, it is possible to obtain the honed surface 35*a* having the little plastic flow 37*a* in the finishing honing and making it difficult to generate microscopic burrs 41. Since the graphite 43*a* is less influenced by the little plastic flow 37*a*, the graphite 43*a* is easily exposed to the surface and the exposure degree of the graphite 43*a* using the honing method B including reverse rotation in the finishing honing improves about 20% from that using the conventional honing method A as shown in FIG. 6. Further, as shown in FIG. 5, the shape accuracy using the honing method B including reverse rotation in the finishing honing improves about 30% from that using the conventional honing method A.

A case of honing a workpiece by rotating the honing head in the finishing honing step in the same direction to that of the honing head in the coarse honing step similarly to the conventional art will be described. In this case, the above-stated advantages cannot be attained but only the advantage derived from the finishing honing can be obtained. Due to this, it is necessary to conduct additional honing steps such as a cork honing step using a cork material instead of hones and a plateau honing step using hones containing abrasive grains far smaller in grain size than those of the finishing honing hones, thereby disadvantageously pushing up the cost.

Next, the advantages of combining the provision of the idling step section 102 and the reverse rotation of the honing head in the finishing honing step section 103 will be described.

As stated in the description related to the advantages of providing the idling step section 102, the cutting of the hones improves, thereby reducing grinding resistance and improving the shape accuracy of the honed surface. If the function of the reverse rotation is added to these advantages, the grinding resistance is further reduced and the shape accuracy of the honed surface further improves about 10% as indicated by a honing method D (B+C) shown in FIG. 5 and eventually improves about 60% from that using the conventional honing method A.

As shown in FIG. 4, even with the function of the reverse rotation of the honing head in the finishing honing step section 103, the increase of the grinding resistance (load) 39 due to the moving of the abrasive grains 33 of the finishing honing hones 19 so as to surpass the plastic flow 37 generated by the coarse honing becomes almost equal to the reduction of the grinding resistance due to the material peel-off effect, and the grinding efficiency as a whole is insufficient.

However, if the above-stated reverse rotation function is added to the functions obtained by the idling step 102, the resistance of the plastic flow serves as additional load 39 on the abrasive grains 39. As a result, even the abrasive grains which are not influenced by the autogeneous function only by providing the idling step section 102 become autogeneous, thus further increasing abrasive grains that cut well. Consequently, the grinding resistance is reduced as compared with the grinding resistance only by providing the idling step section 102, and the shape accuracy of the honed surface improves.

In such an improvement of the shape accuracy, neither the expansion speed of the coarse honing hones 17 is decelerated in the coarse honing step section 101 nor does finishing honing time increase. Therefore, the extension of the honing time is avoided.

Next, the advantage of supplying the coolant in the idling step section 102 will be described.

As shown in FIG. 1, in the idling step section 102, the coolant equal in temperature condition among the coarse honing step section 101, the idling step section 102 and the finishing honing step section 103 is supplied from the common coolant supply source 29. If the workpiece is simply left as it is in the idling step section 102 after the step of the coarse honing step section 101, temperature suddenly changes after the coarse honing step in which the coolant is supplied, the springback quantity of the inner peripheral surface of the cylinder bore does not become uniform due to the influence of the temperature change, much machining allowance is required in the finishing honing step and long finishing honing time is required, accordingly.

Therefore, by supplying the coolant in the step of the idling step section 102, it is possible to generate the springback quantity more equally to thereby achieve the reduction of the finishing honing time.

The coolant supplied in the step of the idling step section 102 is not always required to be supplied from the common coolant supply source 29 common to the coarse honing step section 101 and the finishing honing step section 103 but may be supplied from an independent coolant supply source. However, by using the common coolant supply source 29, the respective steps become almost equal in coolant temperature and it is unnecessary to provide a dedicated coolant supply source to the idling step section 102, thereby making it possible to simplify the overall apparatus.

Although the invention has been described above by reference to certain embodiments of the invention, the invention is not limited to the embodiments described above. Modifications and variations of the above embodiments will occur to those skilled in the art, in light of the above teachings. The scope of the invention is defined with reference to the following claims.

What is claimed is:

1. A honing method grinding an inner surface of a cylinder of a workpiece carried on a machining line by rotating a honing head having hones while axially moving the honing head, comprising the steps of:

grinding the inner surface of the cylinder of the workpiece on a coarse honing section, leaving the cylinder on an idling section for a predetermined time without inserting the honing head into the cylinder, and grinding the inner surface of the cylinder of the workpiece on a finishing honing section, wherein the honing head on the coarse honing section is rotated in a reverse direction to a rotational direction of the boning head on the finishing honing section, thereby grinding the inner surface of the cylinder of the workpiece; and wherein a coolant is supplied to the workpiece on the idling section.

2. The honing method according to claim 1, wherein the coolant is set equal in temperature to coolants used on the coarse honing sect; on and the finishing honing section.

3. The honing method according to claim 1, wherein time for which the workpiece is left as it is on the idling section is at least 30 seconds.

4. The honing method according to claim 2, wherein time for which the workpiece is left as it is on the idling section is at least 30 seconds.

5. A honing apparatus for grinding an inner surface of a cylinder of a workpiece that is carried on a machining line by rotating a honing head having hones while axially moving the honing head, the honing apparatus comprising:

a section adapted for a coarse honing step and a section adapted for a finishing honing step provided on the machining line; and a section adapted for an idling step for leaving the workpiece, which has been subjected to the coarse honing step, as it is for a predetermined time without inserting the honing head into the cylinder, wherein the idling section is provided between the coarse honing step section and the finishing honing step section, wherein the apparatus is adapted to supply coolant to the workpiece on the idling section, and wherein the apparatus is further adapted so that a rotational direction of the honing head in the finishing honing step is reverse to a rotational direction of the honing head in the coarse honing step.

6. A honing apparatus for grinding an inner surface of a cylinder of a workpiece carried on a machining line by rotating a honing head having hones while axially moving the honing head, the honing apparatus comprising:

a coarse honing means for grinding the inner surface of the cylinder of the workpiece on the machining line;

a finishing honing means for grinding the inner surface of the cylinder of the workpiece on the machining line; and an idling means on the machining line for leaving the workpiece which has been subjected to the coarse honing step, as it is for a predetermined time without inserting the honing head into the cylinder, wherein the idling means is provided between the coarse honing means and the finishing honing means;

wherein the apparatus includes coolant means to supply coolant to the workpiece on the idling means; and wherein the apparatus is further adapted so that a rotational direction of the honing head in the finishing honing means is reverse to a rotational direction of the honing head in the coarse honing means.

7. The honing apparatus according to claim 5, wherein the apparatus is adapted to set the coolant equal in temperature to coolants used in the coarse honing step section and the finishing honing step section.

8. The honing apparatus according to claim 6, wherein the apparatus is adapted to set the coolant equal in temperature to coolants used in the coarse honing step means and the finishing honing step means.

9. The honing method according to claim 1, wherein the workpiece is a cylinder block for an engine.

* * * * *